US007172445B2

(12) United States Patent
Shimoyama

(10) Patent No.: US 7,172,445 B2
(45) Date of Patent: Feb. 6, 2007

(54) FLAT CIRCUIT CONNECTOR

(75) Inventor: Hiroshi Shimoyama, Isehara (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 11/325,716

(22) Filed: Jan. 5, 2006

(65) Prior Publication Data

US 2006/0154508 A1 Jul. 13, 2006

(30) Foreign Application Priority Data

Jan. 7, 2005 (JP) ..... 2005-002276

(51) Int. Cl.
*H01R 13/15* (2006.01)

(52) U.S. Cl. ..... 439/260; 439/492; 439/329; 439/495

(58) Field of Classification Search ..... 439/492–495, 439/260, 329

See application file for complete search history.

(56) References Cited

U.S. PATENT DOCUMENTS 5,354,214 A * 10/1994 Aso et al. ..... 439/492

6,231,378 B1 * 5/2001 Wu et al. ..... 439/495

* cited by examiner

*Primary Examiner*—Truc Nguyen
(74) *Attorney, Agent, or Firm*—Charles S. Cohen

(57) ABSTRACT

An electrical connector is provided for terminating a flat electrical circuit. The connector includes a dielectric housing having an opening for receiving an end of the flat circuit. A plurality of signal terminals are mounted on the housing along the opening and include contact portions for engaging signal conductors on the flat circuit. At least one ground terminal is mounted on the housing and includes a contact portion for engaging a ground conductor on the flat circuit. An actuator is movably mounted on the housing for movement between an open position allowing the end of the flat circuit to be inserted into the opening and a closed position relatively biasing the flat circuit against the contact portions of the signal terminals. A guide member is movably mounted on the housing independent of the actuator and for movement between an open position allowing the end of the flat circuit to be inserted into the opening and a closed position relatively biasing the flat circuit against the contact portion of the ground terminal.

15 Claims, 9 Drawing Sheets

FLAT CIRCUIT CONNECTOR

FIELD OF THE INVENTION

This invention generally relates to the art of electrical connectors and, particularly, to a connector for terminating a flat circuit, such as a flat flexible circuit, a flexible printed circuit or other flat electrical cable.

BACKGROUND OF THE INVENTION

A wide variety of electrical connectors have been designed for terminating flat cables or circuits, such as flat flexible cables, flexible printed circuits or the like. A typical connector for flat circuits includes a dielectric housing molded of plastic material, for instance. The housing has an elongated opening or slot for receiving an end of the flat circuit which has generally parallel, laterally spaced conductors exposed across the end. A plurality of terminals are mounted in the housing and are spaced laterally along the slot, with contact portions of the terminals engageable with the laterally spaced conductors of the flat circuit. An actuator often is movably mounted on the housing for movement between a first position whereat the flat circuit is freely insertable into the slot and a second position whereat the actuator clamps the circuit in the housing and biases the circuit against the contact portions of the terminals. An example of these types of connectors is shown in Japanese Patent Application Laid-Open No. 2004-87361.

FIG. 1 shows a sectional view through a flat circuit connector of the prior art. The connector includes a housing, generally designated 10, having an insertion opening 12 for allowing insertion of a flat circuit, such as a flexible printed circuit, into the connector. A plurality of conductive terminals, generally designated 14, are mounted on the housing and are arranged in a spaced array along the opening. Each terminal has a contact portion 14*a* extending into the opening for engaging a conductor on a face of the flat circuit. An actuator, generally designated 16, is pivotally mounted on the connector for rotation from an open position (shown in phantom) allowing the end of the flat circuit to be inserted into opening 12 and a closed position (shown in full lines) whereat a pressing portion 16*a* of the actuator biases the flat circuit against the contact portions 14*a* of terminals 14 and prevents removal of the circuit. Signal conductors on the surface of the flat circuit are pressed against the contact portions of the terminals to connect the flat circuit to a printed circuit board through tail portions 14*b* of the terminals.

With the prior art connector of FIG. 1, actuator 16 presses the flat circuit against contact portions 14*a* of the terminals only at a single location with respect to the insertion direction of the flat circuit. Therefore, if the flat circuit has ground conductors, exposed portions of the ground conductors and the exposed portions of the signal conductors are located at different positions with respect to the insertion direction of the flat circuit. As a result, actuators such as actuator 16, cannot press the ground conductors against any ground terminals. The present invention is directed to solving these problems in a flat circuit connector which includes both ground terminals and signal terminals.

SUMMARY OF THE INVENTION

An object, therefore, of the invention is to provide a new and improved flat circuit connector of the character described.

In the exemplary embodiment of the invention, an electrical connector is provided for terminating a flat electrical circuit. The connector includes a dielectric housing having an opening for receiving an end of the flat circuit. A plurality of signal terminals are mounted on the housing along the opening and include contact portions for engaging signal conductors on the flat circuit. At least one ground terminal is mounted on the housing and includes a contact portion for engaging a ground conductor on the flat circuit. An actuator is movably mounted on the housing for movement between an open position allowing the end of the flat circuit to be inserted into the opening and a closed position relatively biasing the flat circuit against the contact portions of the signal terminals. A guide member is movably mounted on the housing independent of the actuator and for movement between an open position allowing the end of the flat circuit to be inserted into the opening and a closed position relatively biasing the flat circuit against the contact portion of the ground terminal.

According to one aspect of the invention, the actuator is mounted on the housing for pivotal movement between its open and closed positions. The guide member is mounted on the housing for sliding movement between its open and closed positions. The actuator has a pressing portion for engaging the flat circuit and biasing the circuit against the contact portions of the signal terminals. The guide member has a pressing portion for engaging the flat circuit and biasing the circuit against the contact portion of the ground terminal.

According to another aspect of the invention, the guide member is mounted on the housing closer to a mouth of the opening than the actuator, whereby the guide member guides the flat circuit into the opening. The contact portion of the ground terminal is located nearer to the mouth of the opening than the contact portions of the signal terminals.

According to a further aspect of the invention, the guide member is interengaged with the actuator for conjoint movement therewith. The actuator has a cam portion for engaging and moving the guide member from its open to its closed position automatically in response to the actuator moving from its open to its closed position.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
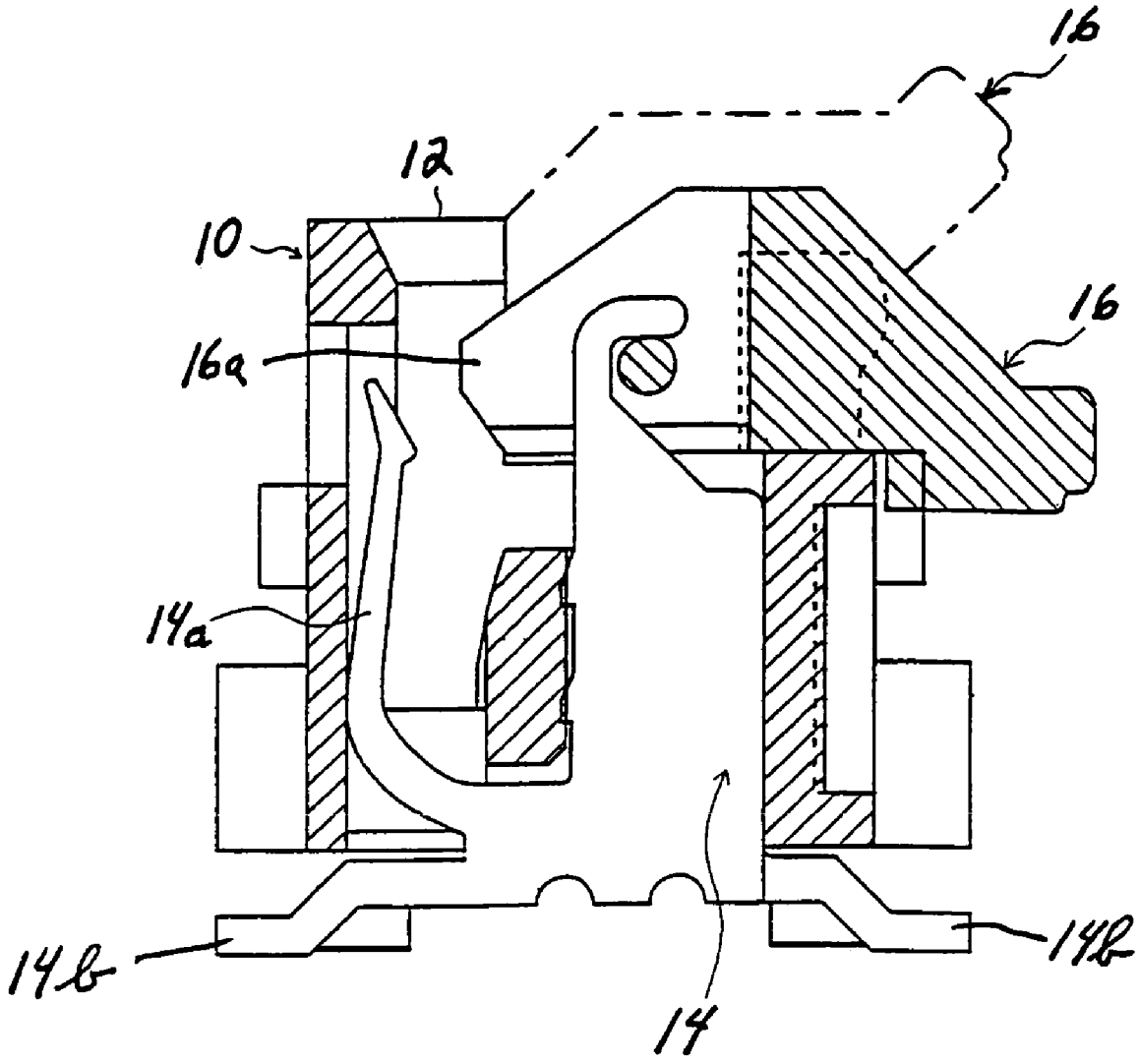
FIG. 1 (PRIOR ART)
FIG. 1 is a sectional view through the prior art connector as described in the Background, above.
Figure 2:
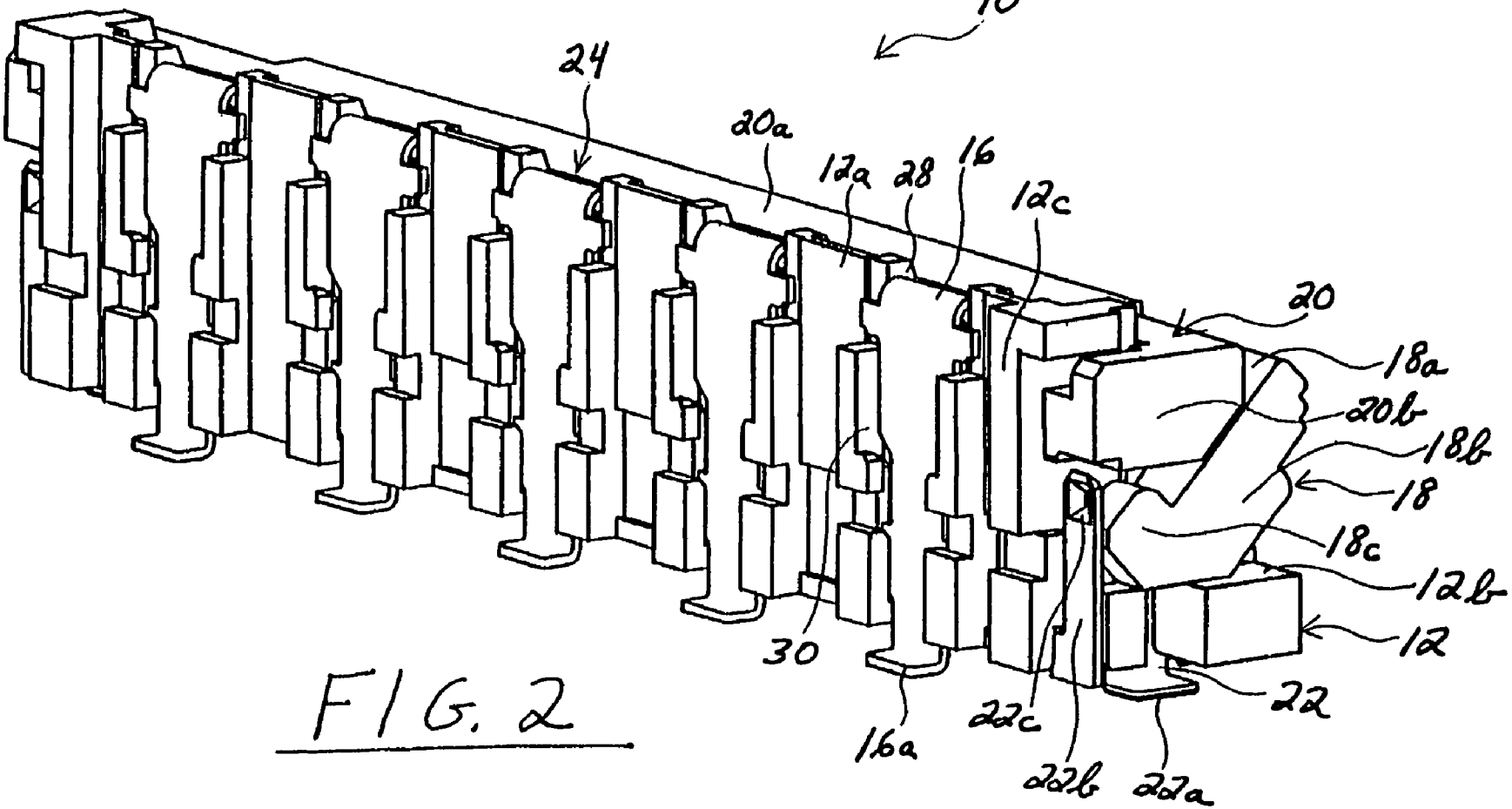
FIG. 2 is a front perspective view of a flat circuit connector according to the invention.
Figure 3:
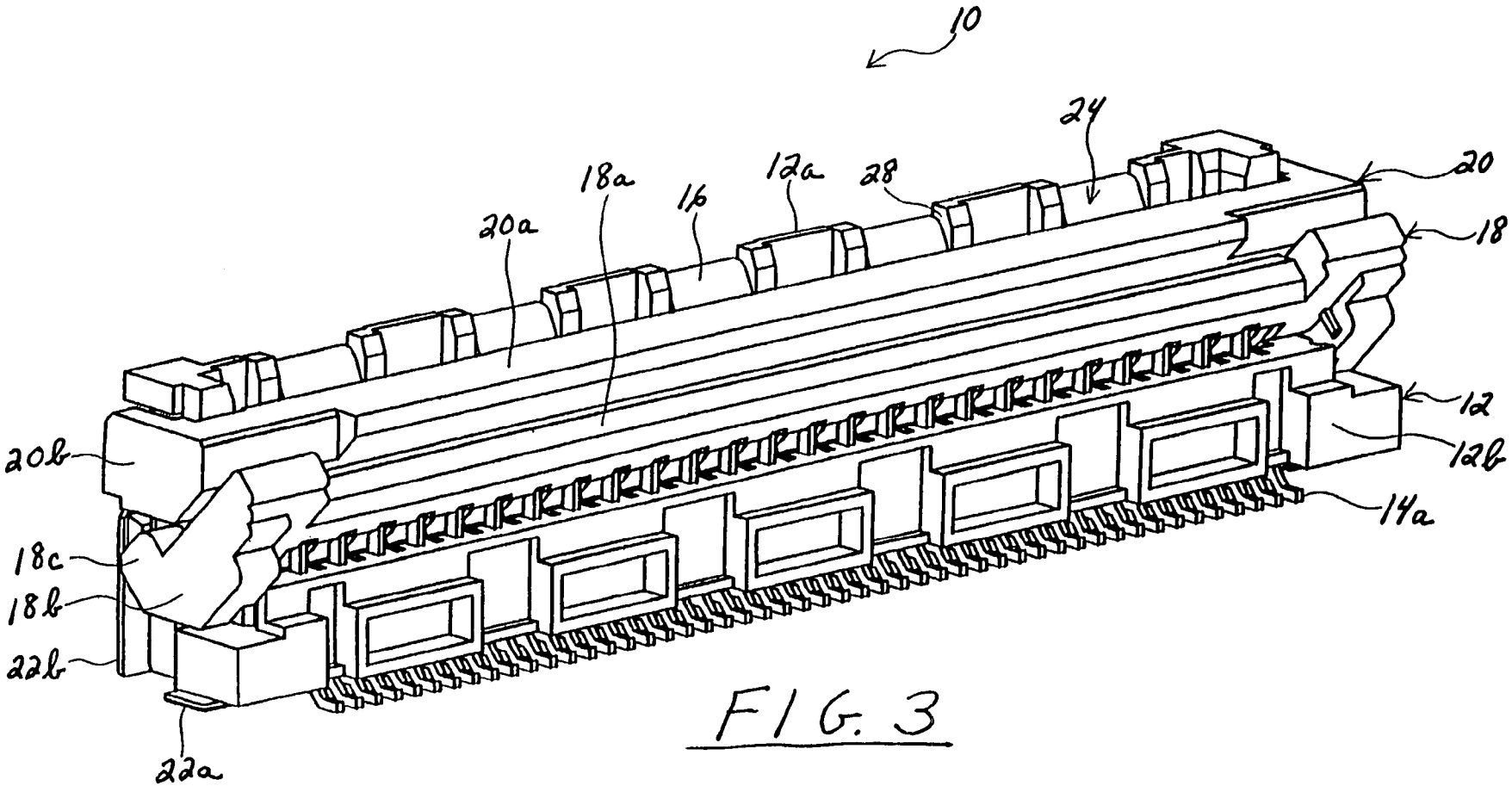
FIG. 3 is a rear perspective view of the connector.
Figure 4:
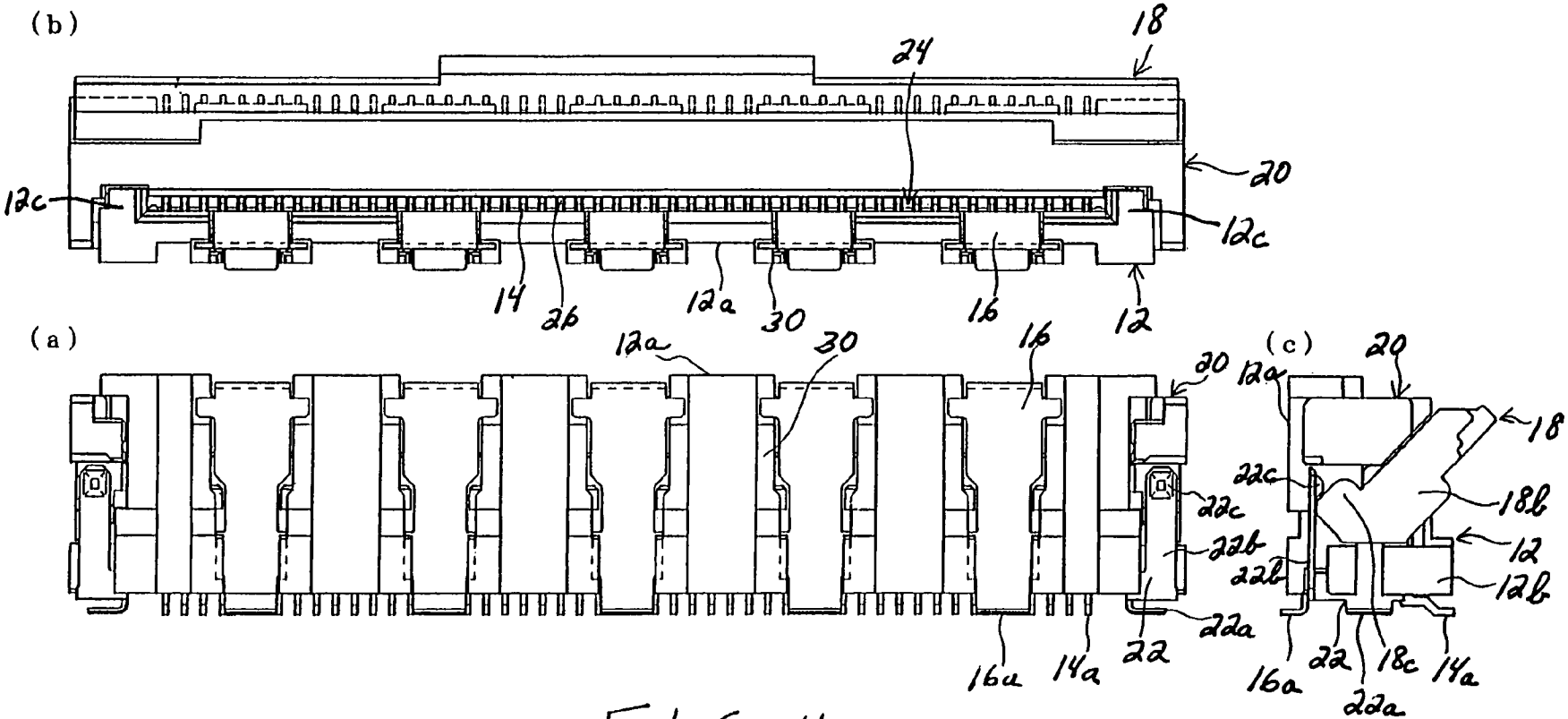
FIGS. 4(*a*), (*b*) and (*c*) are front elevational, top plan and side elevational views, respectively, of the connector.

Referring to the drawings in greater detail, and first to FIGS. 2–4, the invention is embodied in a flat circuit connector, generally designated 10. The connector can terminate various flat circuits, such as a flat flexible circuit, a flexible printed circuit or other flat electrical cables. Generally, connector 10 includes a dielectric housing, generally designated 12; a plurality of signal terminals 14 (FIG. 4) mounted on the housing; a plurality of ground terminals 16 mounted on the housing; an actuator, generally designated 18, pivotally mounted on the housing; and a guide member, generally designated 20, slidably mounted on the housing. In addition, a pair of fitting nails 22 are mounted on the housing at opposite ends thereof for fixing the housing to a printed circuit board.

At this point, it should be understood such terms as "front", "rear", "top", "bottom", "up", "down", and the like herein and in the claims hereof are not intended in any way to be limiting. Such terms are used solely for providing a clear and concise understanding of the invention as viewed in the drawings, the connector being omni-directional in both use and function. For instance, FIGS. 2–4 show connector 10 mounted in a vertical orientation for securement on top of a printed circuit board. Therefore, fitting nails 22 have tails portions 22*a* at the bottoms thereof for securement, as by soldering, to appropriate mounting pads on the printed circuit board (not shown).

With those understandings, housing 12 of connector 10 is elongated and includes an opening, generally designated 24, which runs longitudinally of the housing for receiving an end of a flat circuit. The opening opens at the top of the connector whereby the flat circuit is inserted downwardly into the opening. The housing is a one-piece structure which may be molded of dielectric material such as plastic or the like. The housing has a front portion 12*a*, a rear portion 12*b* and opposite end portions 12*c*, all of which combine to define elongated opening 24. A plurality of terminal-receiving grooves 26 are formed in the housing at spaced intervals along opening 24 for receiving signal terminals 14. In the illustrated embodiment, approximately twenty terminal-receiving grooves 26 are formed at a pitch of, for example, approximately 0.5 mm, and a single signal terminal 26 is inserted into each groove. However, it should be understood that signal terminals are not necessarily received in all of the grooves, because some of the signal terminals can be omitted depending upon the arrangement of the signal conductors on the flat circuit.

Each signal terminal 14 has a tail portion 14*a* which extends rearwardly at the bottom of the housing as seen in FIG. 4(*c*) for connection to an appropriate signal circuit trace on the printed circuit board. Ground terminals 16 have tail portions 16*a* which project forwardly at the bottom of the connector for connection to appropriate ground traces on the printed circuit board. Tail portions 14*a* of signal terminals 14, tail portions 16*a* of ground terminals 16 and tail portions 22*a* of fitting nails 22 all are coplanar for connection, as by soldering, to the flat surface of the printed circuit board. As seen best in FIG. 2, each fitting nail 22 has an upwardly projecting spring arm 22*b* which has a rearwardly projecting detent protrusion 22*c* at the free distal end thereof. The spring arm forms a cantilever member.

Figure 7:
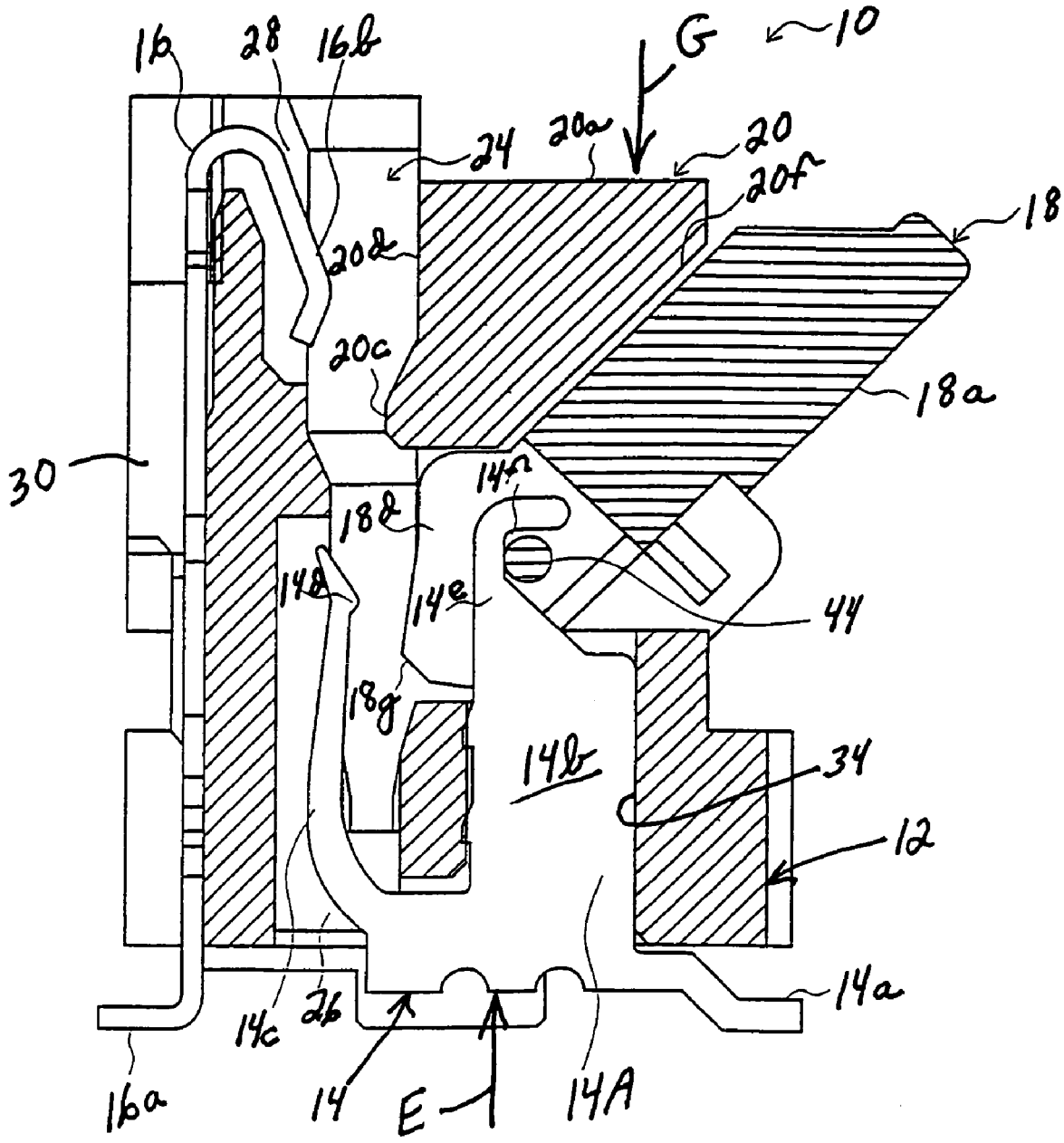
FIG. 7 is a front-to-rear section, on an enlarged scale, showing both the actuator and the guide member in their respective open positions.
Figure 8:
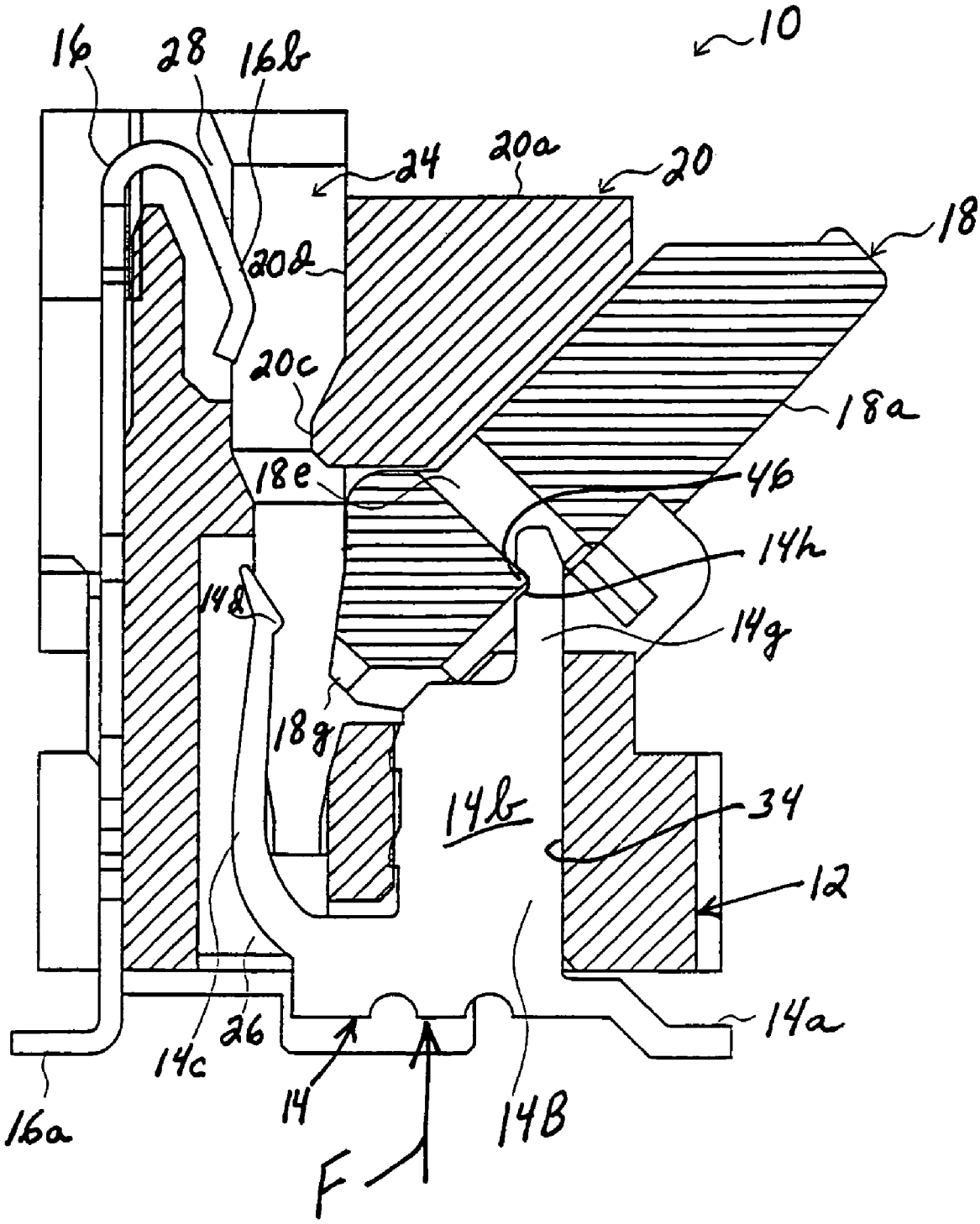
FIG. 8 is a view similar to that of FIG. 7, but taken at a location longitudinally of the connector from the location of FIG. 7.
Figure 9:
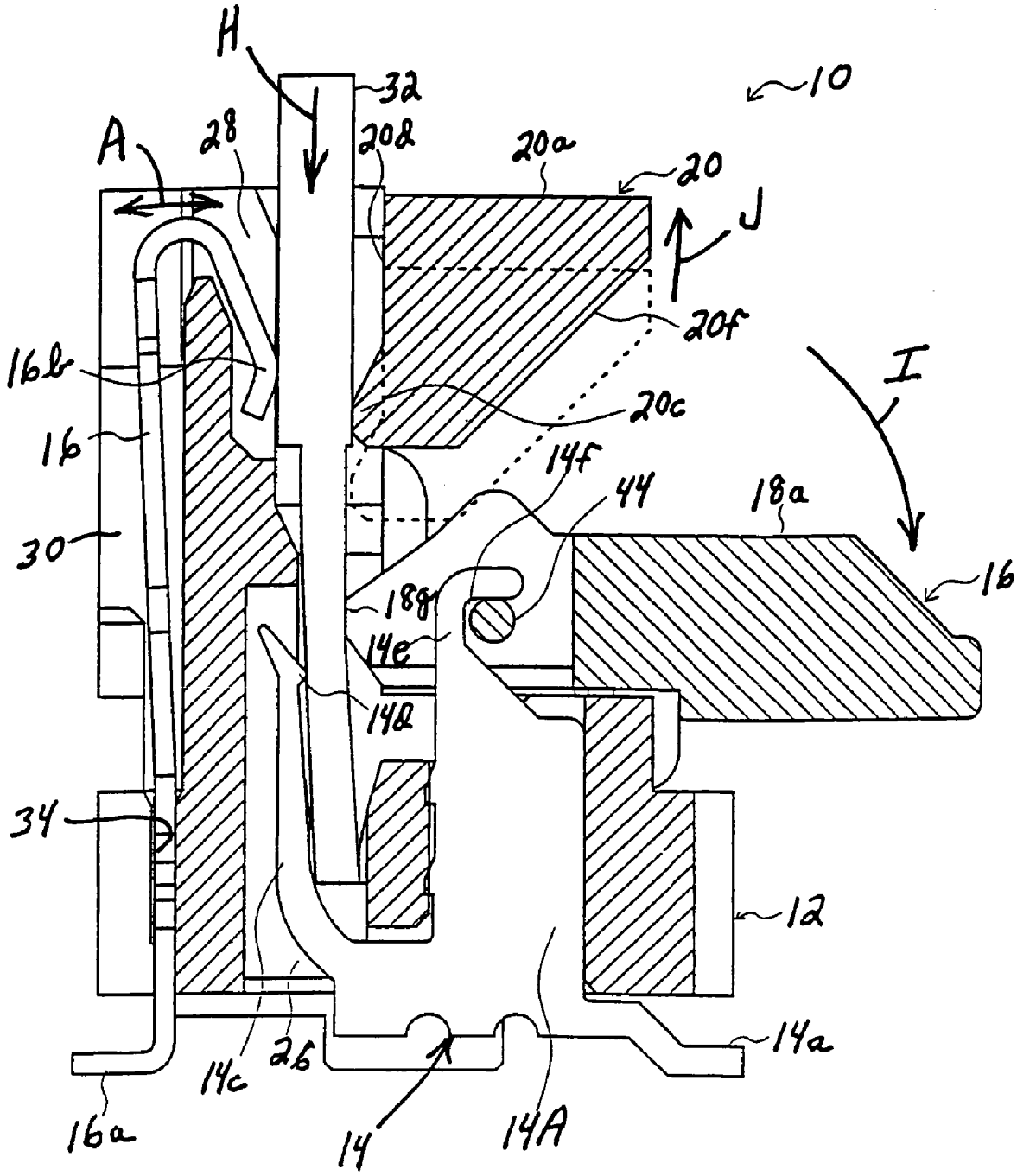
FIG. 9 is a view similar to that of FIG. 7, but with the actuator and the guide member in their respective closed or terminating positions.

Ground terminals 16 are mounted in grooves 28 (FIG. 2) between partitions 30 at front portion 12*c* of the housing. Referring to FIGS. 7–9, it can be seen that each ground terminal 16 has an inverted U-shaped configuration at the top thereof, whereby a contact portion 16*b* is bent back downwardly into opening 24 for engaging a respective ground conductor on a front face of a flat circuit 32 as shown in FIG. 9. In comparing FIGS. 8 and 9, the main body portion of each ground terminal acts as a cantilever member which can move in the direction of double-headed arrow "A" as the bottom of the main body portion is fixed within a slit 34 of the housing. As seen best in FIG. 2, the particular configuration of connector 10 includes five ground terminals 16 at regularly spaced intervals, such as a pitch of approximately 5 mm. However, the number and spacing of the ground terminals can be changed according to the particular configuration of the ground conductors on flat circuit 32. The ground terminals may be stamped and formed of conductive sheet metal material.

Referring to FIGS. 7 and 8, signal terminals 14 have two different configurations 14A and 14B and which alternate longitudinally along elongated opening 24. All of the signal terminals have tail portions 14*a* for connection to the signal traces on the printed circuit board, as described above. All of the signal terminals have body portions 14*b* which fix the terminals within a plurality of terminal-receiving passages 34 in housing 12. All of the signal terminals have upwardly extending contact arms which have contact portions 14*d* at the free distal ends thereof. Contact portions 14*d* are exposed within opening 24 for engaging appropriate signal conductors on flat circuit 32 as seen in FIG. 9. However, signal terminals 14A differ from signal terminals 14B in that signal terminals 14A have upwardly projecting pivot arms 14*e* (FIG. 7) which are L-shaped to define pivot sockets 14*f* for purposes described hereinafter. On the other hand, signal terminals 14B have straight upwardly projecting detent arms 14*g* (FIG. 8) which have detent notches 14*h* for purposes described hereinafter.

Figure 5:
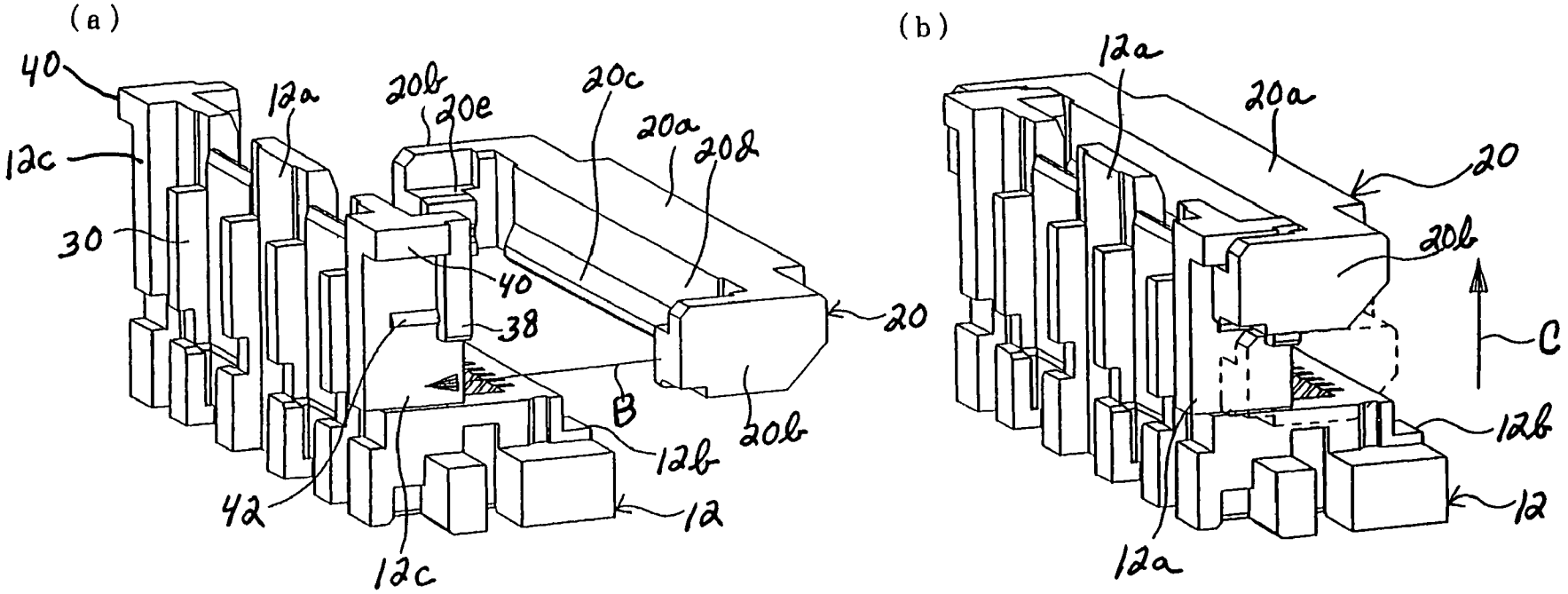
FIGS. 5(*a*) and (*b*) are perspective views showing the assembly of the guide member to the connector housing.

As best seen in FIG. 5(*a*), guide member 20 has an elongated body portion 20*a* and opposite end portions 20*b* which extend forwardly of the body portion. A pressing portion or rib 20*c* projects forwardly along the bottom edge of the body portion in front of a recessed area 20*d* of the body portion. An engagement block 20*e* projects longitudinally inwardly from each end portion 20*b* of the guide member. The distance between the inside surfaces of engagement blocks 20*e* is substantially equal to the distance between the outside surfaces of end portions 12*c* of housing 12. Still referring to FIG. 5(*a*), housing 12 has a vertically extending guide rib 38, a horizontally extending stop rib 40 and a horizontal detent rib 42, all of which project outwardly of the end face of each end portion 12*c* of the housing. Detent ribs 42 do not project outwardly as far as guide ribs 38 and stop ribs 40.

Guide member 20 is assembled to housing 12 in the direction of arrow "B" as seen in FIG. 5(*a*). During assembly, engagement blocks 20*e* of the guide member ride along the outside surfaces of end portions 12*c* of the housing. Once the guide member reaches its limit of movement, the guide member then is moved upwardly relative to the housing in the direction of arrow "C" as seen in FIG. 5(*b*). During upward movement of the guide member, engagement blocks 20*e* move upwardly along the front of the vertically extending guide ribs 38 on the housing until the engagement blocks abut against the horizontally extending stop ribs 40. The engagement blocks ride over horizontal detent ribs 42 until the engagement blocks "snap" into position above the detent ribs as the detent ribs hold the guide member in its upper limit position as seen in FIG. 5(*b*).

Figure 6:
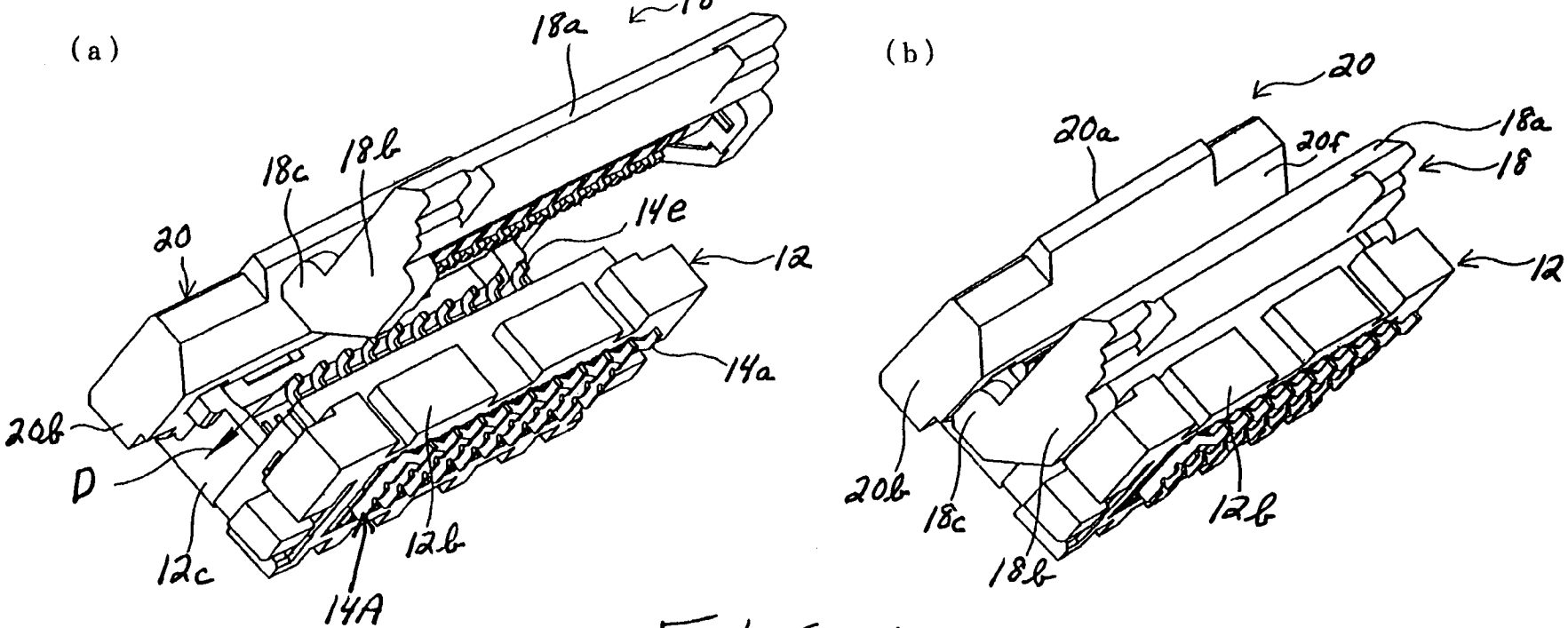
FIGS. 6(*a*) and (*b*) are perspective views showing the assembly of the actuator to the connector housing.

Actuator 18 has an elongated main body portion 18*a* and opposite end portions 18*b*. The opposite end portions also have cam portions 18*c*. As best seen in FIG. 7, the actuator has a plurality of spaced slots 18*d* for accommodating pivot arms 14*e* of signal terminals 14A. As seen in FIG. 8, the actuator also has a plurality of passages or slots 18*e* for accommodating detent arms 14*g* of signal terminals 14B. As with the two different configurations of signal terminals, slots 18*d* and passages 18*e* alternate longitudinally of the actuator. The actuator has pivot pins 44 (FIG. 7) which span slots 18*d* and which seat within pivot sockets 14*f* of pivot arms 14*e*. The actuator also has detent corners 46 (FIG. 8) which seat within detent notches 14*h* of detent arms 14*g* of terminals 14B. Finally, actuator 18 has a pressing portion 18*g* for pressing flat circuit 32 into engagement with contact portions 14*d* of the signal terminals. Actuator 18 is assembled to housing 12 in the direction of arrow "D" as seen in FIG. 6(*a*). The actuator is assembled sort of in a horizontal orientation until the actuator reaches a position as shown in FIG. 6(*b*).

It can be seen in FIGS. 6(*a*) and 6(*b*) that signal terminals 14A already are assembled to housing 12 before actuator 18 is assembled. This allows pivot pins 44 (FIG. 7) of the actuator to move into pivot sockets 14*f* of pivot arms 14*e* of signal terminals 14A.

The sequence of assembling flat circuit connector 10 now will be described. Specifically, guide member 20 is assembled to housing 12 as shown in FIGS. 5(*a*) and (*b*) and as described above. It can be seen in those views that none of the terminals have as yet been mounted on the housing. As described above, the guide member is moved to its temporarily held position of FIG. 5(*b*).

Signal terminals 14A (FIG. 7) then are assembled to the housing in the direction of arrow "E" as body portions 14*b* of the terminals are inserted into the terminal-receiving passages 34 of the housing. At this point, terminals 14B are not inserted into the housing because detent arms 14*g* of the terminals would block assembly of actuator 18.

The actuator then is assembled to housing 12 as shown in FIGS. 6(*a*) and (*b*) and as described above. The actuator is inserted until pivot pins 44 (FIG. 7) seat within pivot sockets 14*f* of signal terminals 14A. When fully inserted, the actuator is pivoted upwardly to its open position as shown in FIGS. 7 and 8, whereupon signal terminals 14B (FIG. 8) can be inserted into the housing in the direction of arrow "F" (FIG. 8).

Actuator 18 is held in its open position of FIGS. 7 and 8 by two distinct means. First, as seen in FIG. 8, the actuator is held in its open position by detent corners 46 of the actuator being disposed within detent notches 14*h* of signal terminals 14B. Second, as seen best in FIGS. 2–4, cam portions 18*c* at opposite ends of the actuator are disposed beneath detent projections 22*c* at the top ends of the cantilevered spring arms 22*b* of fitting nails 22. In the open position of the actuator, flat circuit 32 can be inserted freely into opening 24 of the housing.

Ground terminals 16 can be assembled to the housing practically at any time, but it most likely would be easiest to assemble the ground terminals after the guide member, the actuator and all of the signal terminals have been assembled. In any event, after actuator 18 has been assembled and temporarily held in its open position as described above, guide member 20 can be pushed downwardly in the direction of arrow "G" (FIG. 7) until a bottom inclined surface 20*f* of the guide member interengages with the top of actuator 18 as seen in FIGS. 7 and 8. The guide member is pushed downwardly from its temporarily held position shown in FIG. 5(*b*) simply by overriding horizontal detent ribs 42 on the outside faces of the end portions 12*c* of the housing. The guide member now is in its open position shown in FIGS. 7 and 8, allowing flat circuit 32 to be inserted freely into opening 24 of the housing. It can be seen that there is considerable spacing between pressing portion 20*c* of the guide member and the opposite side opening 24 for the flat circuit to be inserted freely into the opening.

After flat circuit 32 is inserted into the connector in the direction of arrow "H" (FIG. 9), actuator 18 is pivoted downwardly in the direction of arrow "I" to its closed position whereat pressing portion 18*g* of the actuator biases flat circuit 32 and its signal conductors into engagement with contact portions 14*d* of signal terminals 14 (14A and 14B).

Generally, actuator 18 is effective to automatically move guide member 20 from its open position to its closed position as the actuator is pivoted to its closed position. Specifically, cam portions 18*c* at opposite ends of the actuator engage the undersides of end portions 20*b* of the guide member and push the guide member from the dotted line position shown in FIG. 9 to the full-line position of the guide member. The guide member effectively biases flat circuit 32 and its ground conductors into engagement with contact portions 16*b* of ground conductors 16, the contact portions projecting into opening 24.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector for terminating a flat electrical circuit, comprising:

a dielectric housing having an opening for receiving an end of the flat circuit;

a plurality of signal terminals mounted on the housing along the opening and including contact portions for engaging signal conductors on the flat circuit;

at least one ground terminal mounted on the housing and including a contact portion for engaging a ground conductor on the flat circuit;

an actuator movably mounted on the housing for pivotal movement between an open position allowing the end of the flat circuit to be inserted into said opening and a closed position relatively biasing the flat circuit against the contact portions of the signal terminals; and a guide member movably mounted on the housing independent of the actuator and for movement between an open position allowing the end of the flat circuit to be inserted into said opening and a closed position relatively biasing the flat circuit against the contact portion of the ground terminal.

2. The electrical connector of claim 1 wherein said actuator is mounted on the housing for pivotal movement between its open and closed positions.

3. The electrical connector of claim 1 wherein said actuator has a pressing portion for engaging the flat circuit and biasing the circuit against the contact portions of the signal terminals.

4. The electrical connector of claim 1 wherein said guide member has a pressing portion for engaging the flat circuit and biasing the circuit against the contact portion of the ground terminal.

5. The electrical connector of claim 1 wherein said guide member is mounted on the housing closer to a mouth of said opening than said actuator whereby the guide member guides the flat circuit into the opening.

6. The electrical connector of claim 1 wherein the contact portion of said ground terminal is located nearer to a mouth of said opening than the contact portions of the signal terminals.

7. The electrical connector of claim 1 wherein said guide member is interengaged with the actuator for conjoint movement therewith.

8. The electrical connector of claim 7 wherein said actuator has a cam portion for engaging and moving the guide member from its open to its closed position in response to the actuator moving from its open to its closed position.

9. An electrical connector for terminating a flat electrical circuit, comprising:

a dielectric housing having an opening for receiving an end of the flat circuit;

a plurality of signal terminals mounted on the housing along the opening and including contact portions for engaging signal conductors on the flat circuit;

at least one ground terminal mounted on the housing and including a contact portion for engaging a ground conductor on the flat circuit;

an actuator pivotably mounted on the housing for movement between an open position allowing the end of the flat circuit to be inserted into said opening and a closed position relatively biasing the flat circuit against the contact portions of the signal terminals;

a guide member slidably mounted on the housing independent of the actuator and for movement between an open position allowing the end of the flat circuit to be inserted into said opening and a closed position relatively biasing the flat circuit against the contact portion of the ground terminal; and said actuator having a cam portion for engaging and sliding the guide member from its open to its closed position in response to the actuator pivoting from its open position to its closed position.

10. The electrical connector of claim 9 wherein said actuator has a pressing portion for engaging the flat circuit and biasing the circuit against the contact portions of the signal terminals.

11. The electrical connector of claim 9 wherein said guide member has a pressing portion for engaging the flat circuit and biasing the circuit against the contact portion of the ground terminal.

12. The electrical connector of claim 9 wherein said guide member is mounted on the housing closer to a mouth of said opening than said actuator whereby the guide member guides the flat circuit into the opening.

13. The electrical connector of claim 9 wherein the contact portion of said ground terminal is located nearer to a mouth of said opening than the contact portions of the signal terminals.

14. An electrical connector for terminating a flat electrical circuit, comprising:

a dielectric housing having an opening for receiving an end of the flat circuit;

a plurality of signal terminals mounted on the housing along the opening and including contact portions for engaging signal conductors on the flat circuit;

at least one ground terminal mounted on the housing and including a contact portion for engaging a ground conductor on the flat circuit;

an actuator movably mounted on the housing for movement between an open position allowing the end of the flat circuit to be inserted into said opening and a closed position relatively biasing the flat circuit against the contact portions of the signal terminals; and a guide member movably mounted on the housing independent of the actuator and for sliding movement between an open position allowing the end of the flat circuit to be inserted into said opening and a closed position relatively biasing the flat circuit against the contact portion of the ground terminal.

15. The electrical connector of claim 14 wherein said guide member has means cooperating with the dielectric housing for holding the guide member in the closed position.

* * * * *